US009352235B1

(12) United States Patent
Chin

(10) Patent No.: US 9,352,235 B1
(45) Date of Patent: May 31, 2016

(54) CLAMPED SLIDE ASSEMBLY

(71) Applicant: T. K. CHIN COMPANY LTD., Taipei (TW)

(72) Inventor: Howard Chin, Taipei (TW)

(73) Assignee: T. K. CHIN COMPANY LTD., Taipei (TW)

( * ) Notice: Subject to any disclaimer, the term of this patent is extended or adjusted under 35 U.S.C. 154(b) by 0 days.

(21) Appl. No.: 14/928,400

(22) Filed: Oct. 30, 2015

(30) Foreign Application Priority Data

Aug. 17, 2015 (TW) ..... 104126761 A

(51) Int. Cl.
*A63G 21/00* (2006.01)
*A63B 9/00* (2006.01)

(52) U.S. Cl.
CPC ..... *A63G 21/00* (2013.01)

(58) Field of Classification Search
CPC ..... A63G 21/00; A63G 21/02; A63B 9/00; A63B 2009/006; E06C 7/00; E06C 7/086; E06C 7/08
USPC ..... 472/116–117, 128, 136; 482/35, 36; 182/228.6
See application file for complete search history.

(56) References Cited

U.S. PATENT DOCUMENTS 3,969,871 A * 7/1976 Ewers ..... A63G 21/00 403/195
4,252,313 A * 2/1981 Skalka ..... A63B 9/00 182/228.6
4,549,324 A * 10/1985 Liou ..... B23D 29/007 30/168
5,197,924 A * 3/1993 Gerrells ..... A63H 33/00 446/168
7,594,874 B2 * 9/2009 Meissner ..... A63B 69/0048 482/36
2013/0150171 A1 * 6/2013 Khanna ..... A63G 21/00 472/116

* cited by examiner

*Primary Examiner* — Kien Nguyen
(74) *Attorney, Agent, or Firm* — Rabin & Berdo, P.C.

(57) ABSTRACT

The clamped slide assembly comprises a slide, a main body, at least one inner clamping panel, and a clamping unit. The slide has a platform. The main body is securely mounted on the platform. The at least one inner clamping panel is securely mounted on the platform. The clamping unit is movably mounted on the main body and has an outer clamping panel, a screwing rod, and a spanner. The outer clamping panel is spaced apart from the inner clamping panel. The screwing rod is screwed with the main body. The screwing rod is mounted through the outer clamping panel. The spanner is rotatably and eccentrically mounted around the screwing rod, and the outer clamping panel is pushed towards the main body and the inner clamping panel to fasten on an open riser stair, and the clamped slide assembly can achieve the goal of saving space.

18 Claims, 8 Drawing Sheets

CLAMPED SLIDE ASSEMBLY

CROSS-REFERENCE TO RELATED APPLICATIONS

This application is based upon and claims priority under 35 U.S.C. 119 from Taiwan Patent Application No. 104126761 filed on Aug. 17, 2015, which is hereby specifically incorporated herein by this reference thereto.

BACKGROUND OF THE INVENTION

1. Field of the Invention

The present invention relates to a slide assembly combined with stair.

2. Description of the Prior Arts

Slide is a common entertainment facility. The conventional slide has a climbing section, a platform, and a sliding section. The conventional slide can be made of rocks, metal or plastic. The slide made of rocks or metal is stable and durable, so the slide made of rocks or metal is often placed in a park or a playground for the public. The slide made of plastic is light and is easy to transport, so the size of the plastic slide is reduced and is placed in an indoor playground for the children. However, the conventional plastic slide occupies the indoor space and is placed on the ground by its weight, so the conventional plastic slide is not firmly fixed on the ground. Children are exposed to risks when playing on the plastic slide.

To overcome the shortcomings, the present invention provides a clamped slide assembly to mitigate or obviate the aforementioned problems.

SUMMARY OF THE INVENTION

The main objective of the present invention is to provide a clamped slide assembly to be combined with an open riser stair and is firmly mounted on the open riser stair to achieve the goal of saving indoor space and improving stability.

The clamped slide assembly comprises a slide, a main body, at least one inner clamping panel, and a clamping unit. The slide has a platform and a sliding section, and the sliding section is connected to the platform. The main body is securely mounted on a bottom of the platform of the slide and has an adjusting screw hole. The at least one inner clamping panel is securely mounted on the platform of the slide or the main body and each one of the at least one inner clamping panel extends downward. The clamping unit is movably mounted on the main body and has an outer clamping panel, a screwing rod, and a spanner. The outer clamping panel is spaced apart from the at least one inner clamping panel. An inner end of the screwing rod is screwed with the adjusting screw hole of the main body. The screwing rod is mounted through the outer clamping panel and an outer end of the screwing rod extends out of the outer clamping panel. The spanner is rotatably and eccentrically mounted on the outer end of the screwing rod, and the outer clamping panel is pushed towards the main body and the at least one inner clamping panel by rotating the spanner.

The clamped slide assembly in accordance with the present invention is applied to an open riser stair. A depth of the screwing rod screwed with the adjusting screw hole is adjusted according to a width of each one of the treads of the open-riser stair to decide a distance between the outer clamping panel and the main body. After finishing the width adjustment, the main body is put on a top surface of one of the treads of the open riser stair, the at least one inner clamping panel abuts on a back surface of the tread, and the outer clamping panel abuts on a front surface of the tread opposite to the at least one inner clamping panel. The spanner is rotated to pull the screwing rod and to push the outer clamping panel, so the outer clamping panel and the inner clamping panel tightly clamp the tread, and the clamped slide assembly can be securely fastened on the open riser stair to achieve the goal of saving space.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
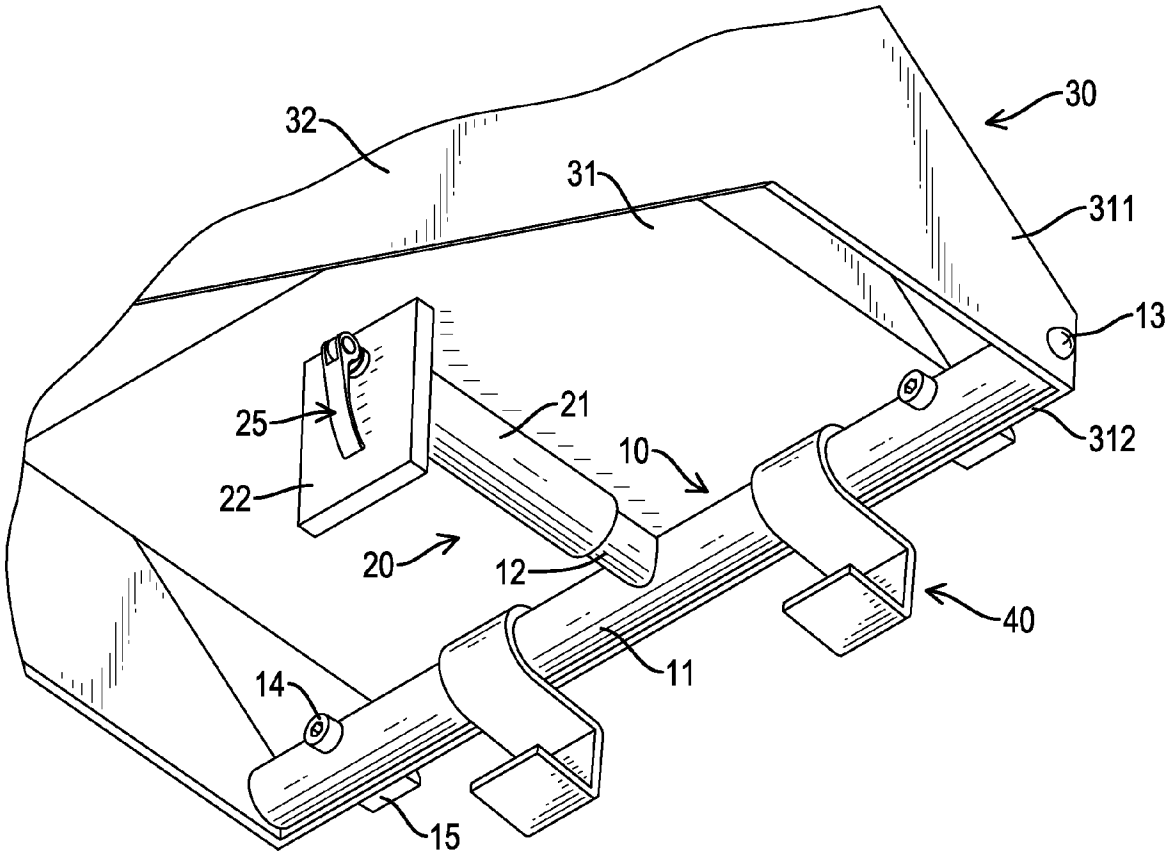
FIG. 1 is a perspective view of a first embodiment of a clamped slide assembly in accordance with the present invention.
Figure 2:
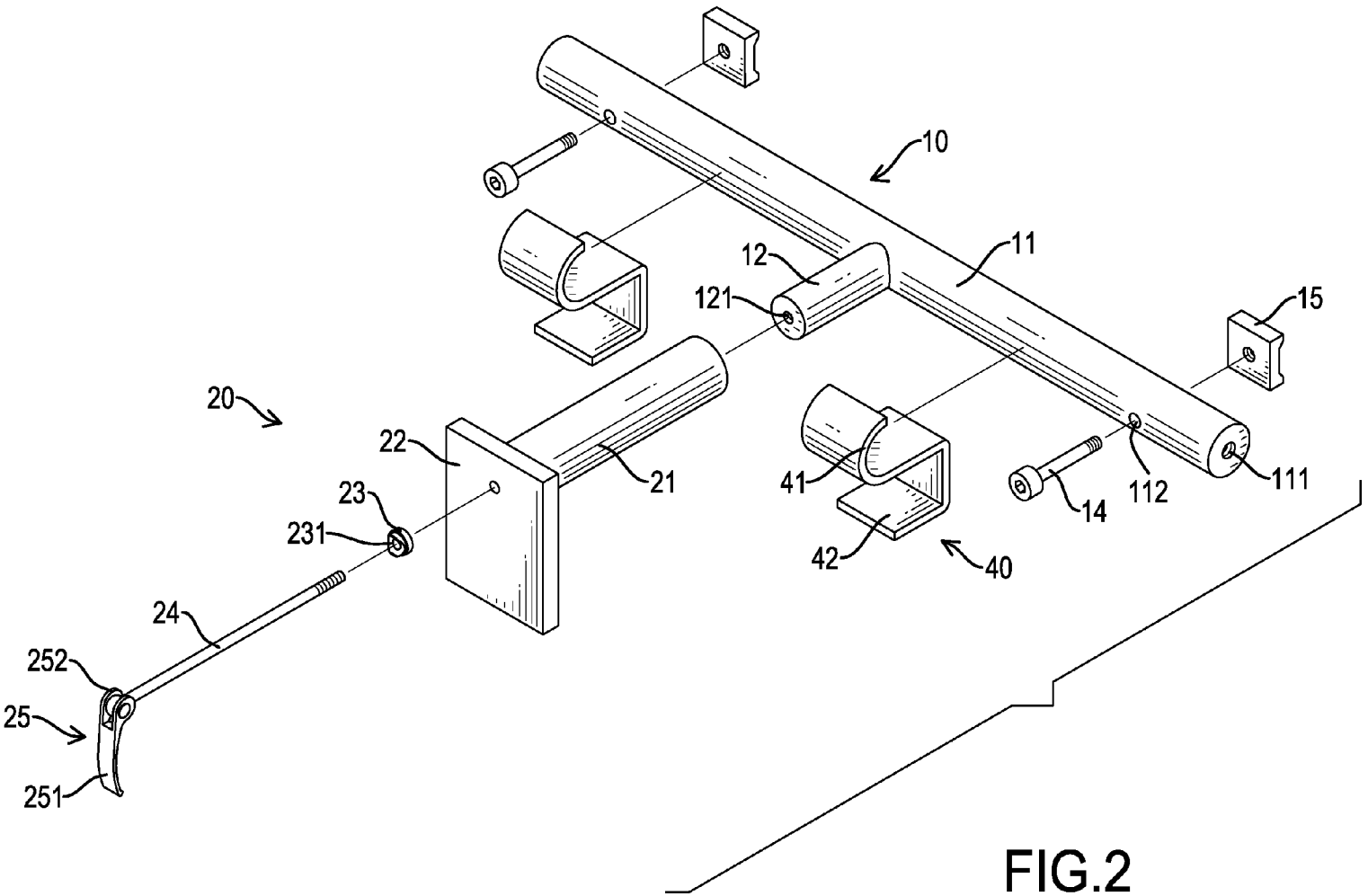
FIG. 2 is an exploded perspective view of the clamped slide assembly in FIG. 1.

With reference to FIGS. 1 and 2, a first embodiment of a clamped slide assembly in accordance with the present invention comprises a slide 30, a main body 10, a clamping unit 20, and two inner clamping panels 40.

Figure 3:
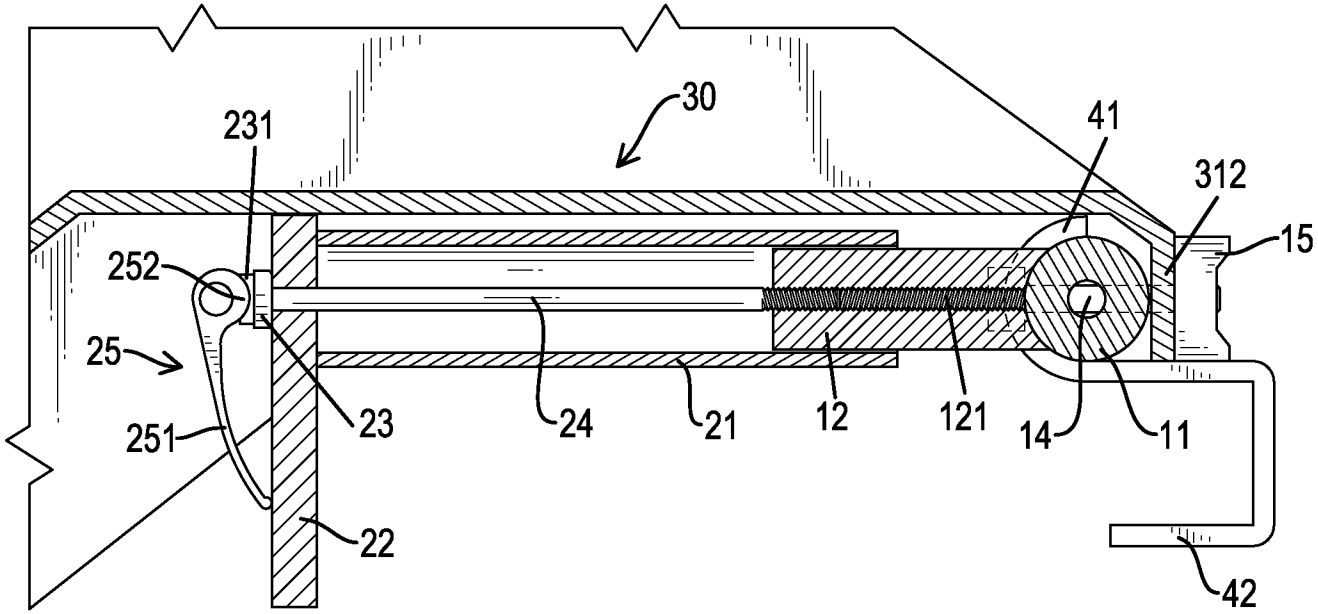
FIG. 3 is a cross-sectional side view of the clamped slide assembly in FIG. 1.

With reference to FIGS. 1 to 3, the slide 30 has a platform 31 and a sliding section 32. The platform 31 has two locking plates 311 and a clamping plate 312. The two locking plates 311 are mounted oppositely on two sides of the platform 31. The clamping plate 312 is formed between the two locking plates 311. The sliding section 32 is connected to the platform 31 and extends obliquely and downward from the platform 31. In a preferred embodiment, the slide 30 is an integrated structure or a combined structure. As a combined structure, the slide 30 is assembled with multiple components.

With reference to FIGS. 1 to 3, the main body 10 is securely mounted on the platform 31 of the slide 30 and has a supporting rod 11, a connecting rod 12, two locking members 13, two clamping bolts 14, and two pushing blocks 15. The supporting rod 11 abuts on the clamping plate 312 of the platform 31 and has two locking holes 111 and two clamping holes 112, the two locking holes 111 are disposed through two opposite ends of the supporting rod 11, and the two clamping holes 112 are disposed through an outer wall of the supporting rod 11 and are respectively adjacent to the two opposite ends of the supporting rod 11. The connecting rod 12 is perpendicularly formed on the outer wall of the supporting rod 11 and is disposed between the two clamping holes 112 of the supporting rod 11. The connecting rod 12 has an adjusting screw hole 121 formed on an end distal from the supporting rod 11. The two locking members 13 are respectively mounted through the two locking plates 311 of the platform 31 and are screwed in the two locking holes 111 of the supporting rod 11. The two clamping bolts 14 are respectively mounted through the two clamping holes 112 of the supporting rod 11 and the clamping plate 312 of the platform 31. The two pushing blocks 15 are respectively screwed with the two clamping bolts 14 and abut on the clamping plate 312 to clamp the slide 30. In a preferred embodiment, the pushing blocks 15 are made of resilient materials. The pushing blocks 15 are mounted on the slide 30 as protective layers to prevent the slide 30 from directly bumping into foreign objects when the slide 30 is moved.

With reference to FIGS. 2 and 3, the clamping unit 20 is connected to the main body 10 and has a sleeve 21, an outer clamping panel 22, a forcing plate 23, a screwing rod 24, and a spanner 25. The sleeve 21 is movably mounted around the connecting rod 12 of the main body 10. The outer clamping panel 22 is securely mounted on an end of the sleeve 21 distal from the connecting rod 12. The forcing plate 23 is securely mounted on a side of the outer clamping panel 22 distal from the sleeve 21. The forcing plate 23 has a curved groove 231 formed on a side surface of the forcing plate 23 distal from the outer clamping panel 22. The screwing rod 24 is mounted through the forcing plate 23, the outer clamping panel 22 and the sleeve 21 and has a thread, and the thread is formed on an end of the screwing rod 24. The thread of the screwing rod 24 is screwed with the adjusting screw hole 121 of the connecting rod 12. The spanner 25 has a turning portion 251 and two forcing portions 252. The two forcing portions 252 are formed at a spaced interval on a surface of the turning portion 251, and the two forcing portions 252 are eccentrically and pivotally mounted around an end of the screwing rod 24 through the forcing plate 23. The two forcing portions 252 of the spanner 25 are selectively pushed by the forcing plate 23. When the turning portion 251 of the spanner 25 and the screwing rod 24 are in a fastened condition, the outer edges of the two forcing portions 252 distal from a pivoting center of the two forcing portions 252 abut on the curved groove 231 of the forcing plate 23 to push the outer clamping panel 22 towards the connecting rod 12, and the outer clamping panel 22 is pushed towards the main body 10 by rotating the spanner 25.

With reference to FIGS. 1 to 3, the two inner clamping panels 40 are securely mounted at a spaced interval on the supporting rod 11 of the main body 10. Each one of the two inner clamping panels 40 has a supporting hooking portion 41 and a tread hooking portion 42. The supporting hooking portion 41 and the tread hooking portion 42 are connected to each other. An opening of the supporting hooking portion 41 is distal from the outer clamping panel 22 of the clamping unit 20 and is securely disposed on the outer wall of the supporting rod 11. An opening of the tread hooking portion 42 is disposed towards the outer clamping panel 22 of the clamping unit 20.

Figure 4:
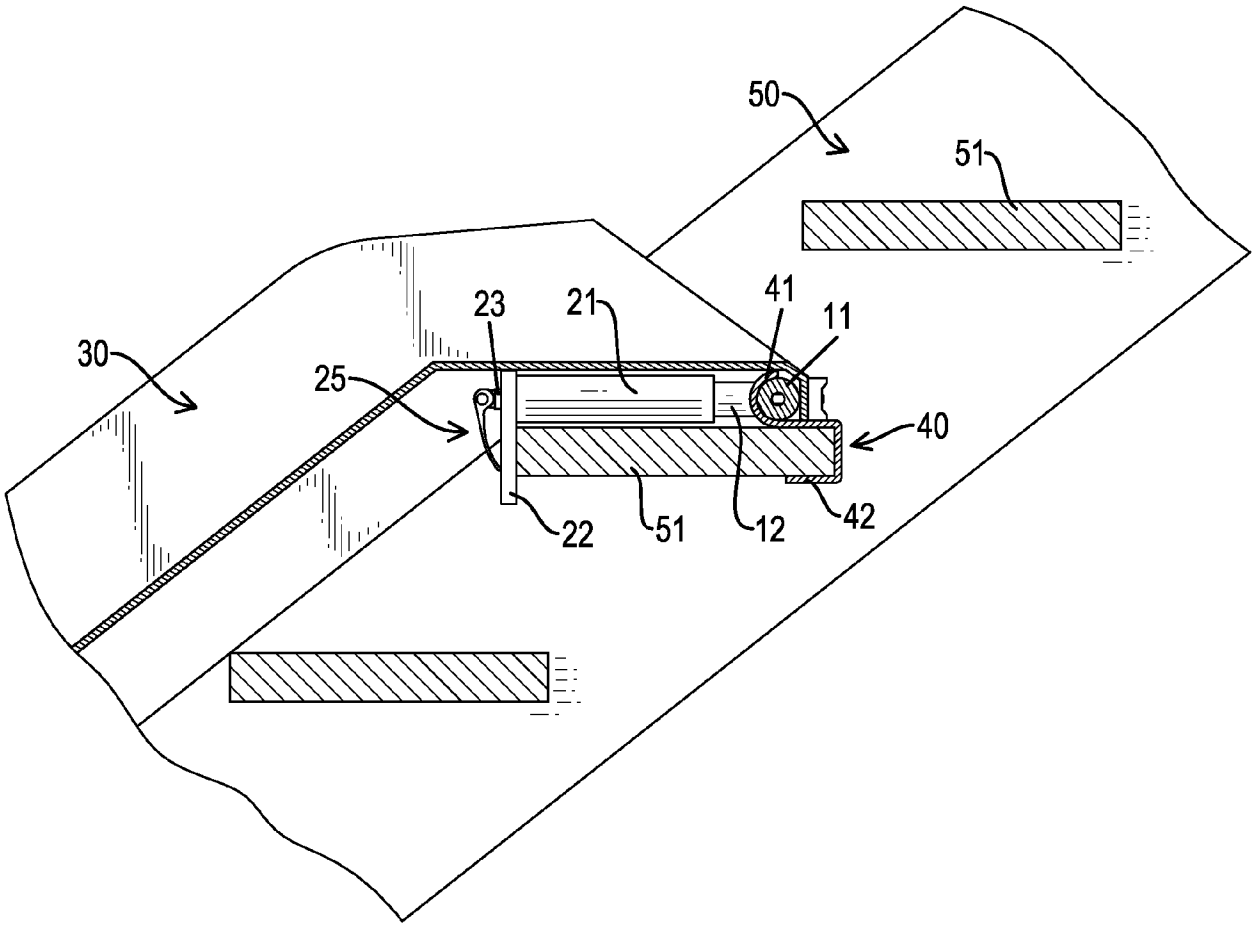
FIG. 4 is an operational and cross-sectional view of the clamped slide assembly in FIG. 1.
Figure 5:
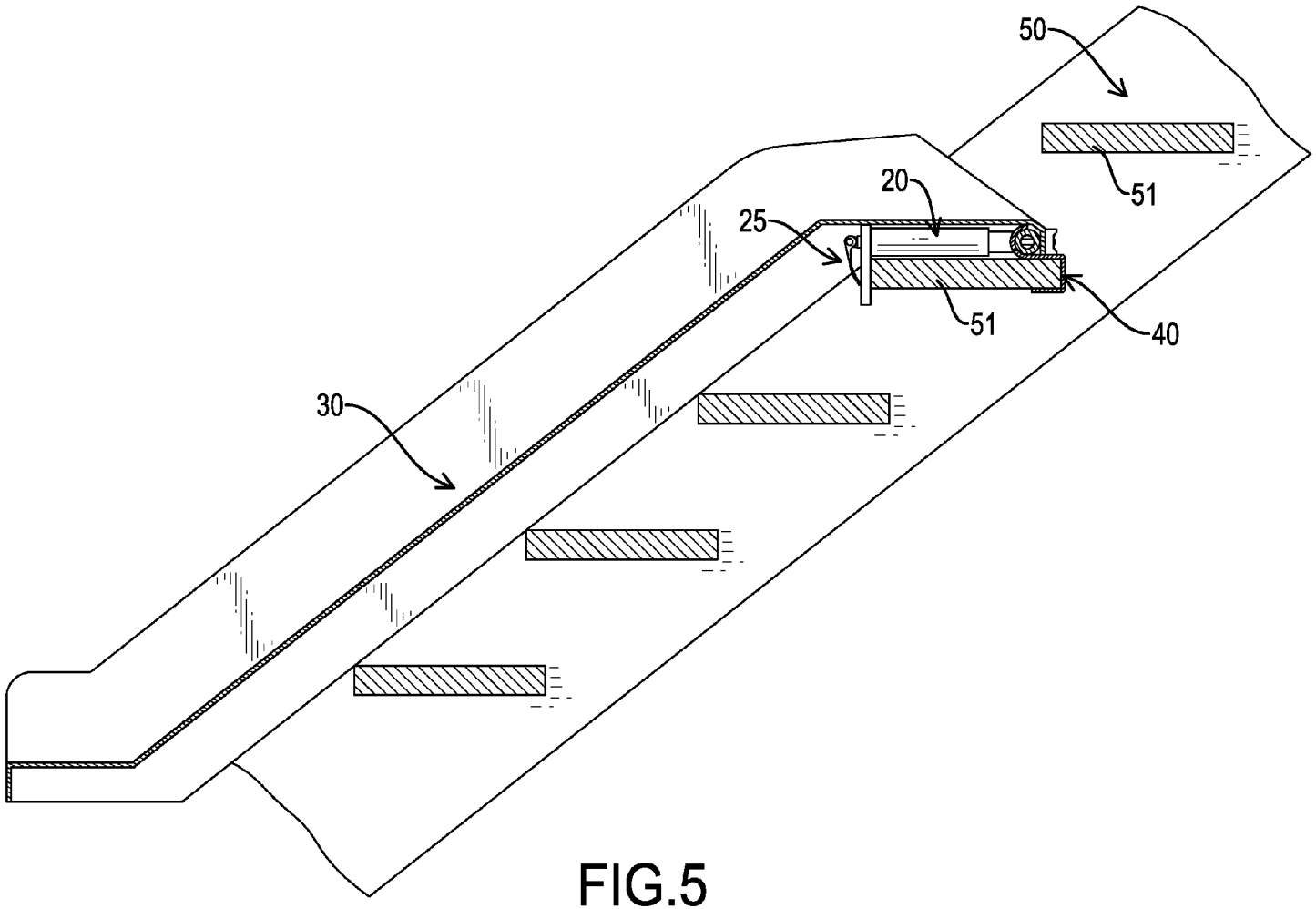
FIG. 5 is a plane view of the clamped slide assembly in FIG. 1, showing the clamped slide assembly mounted on an open riser stair.

With reference to FIGS. 4 and 5, the first embodiment of the clamped slide assembly in accordance with the present invention is applied to an open riser stair 50. The open riser stair 50 has multiple treads 51 that are spaced from each other. The slide 30 and the main body 10 are disposed on one of the treads 51 of the open riser stair 50. The tread hooking portions 42 of the two inner clamping panels 40 are mounted on a back surface of said one of the treads 51. A size of the opening of the tread hooking portion 42 is bigger than or equal to a thickness of each one of the multiple treads 51. According to a width of the tread 51 of the open riser stair 50, a distance between the outer clamping panel 22 and the inner clamping panels 40 is adjusted. After finishing the width adjustment, the outer clamping panel 22 abuts on a front surface of the tread 51 opposite to the two inner clamping panels 40. The turning portion 251 of the spanner 25 is rotated to pull the screwing rod 24 and to push the outer clamping panel 22. The outer clamping panel 22 and the two inner clamping panels 40 are respectively and tightly fastened on the front and back surfaces of the tread 51, and the slide 30 can be securely fastened on the open riser stair 50. When the clamped slide assembly is in use, user slides from the platform 31 of the slide 30 along the sliding section 32 to a bottom of the open riser stair 50. The user could climb the open riser stair 50 to the platform 31 of the slide 30 to continue playing on the slide 30. The present invention is securely mounted on an open riser stair 50 to achieve the goal of saving space, and the outer clamping panel 22 and the two inner clamping panels 40 are fastened at the opposite surfaces of the tread 51 to improve the stability of the slide 30 for reducing the risk when users are playing on the slide 30.

Figure 6:
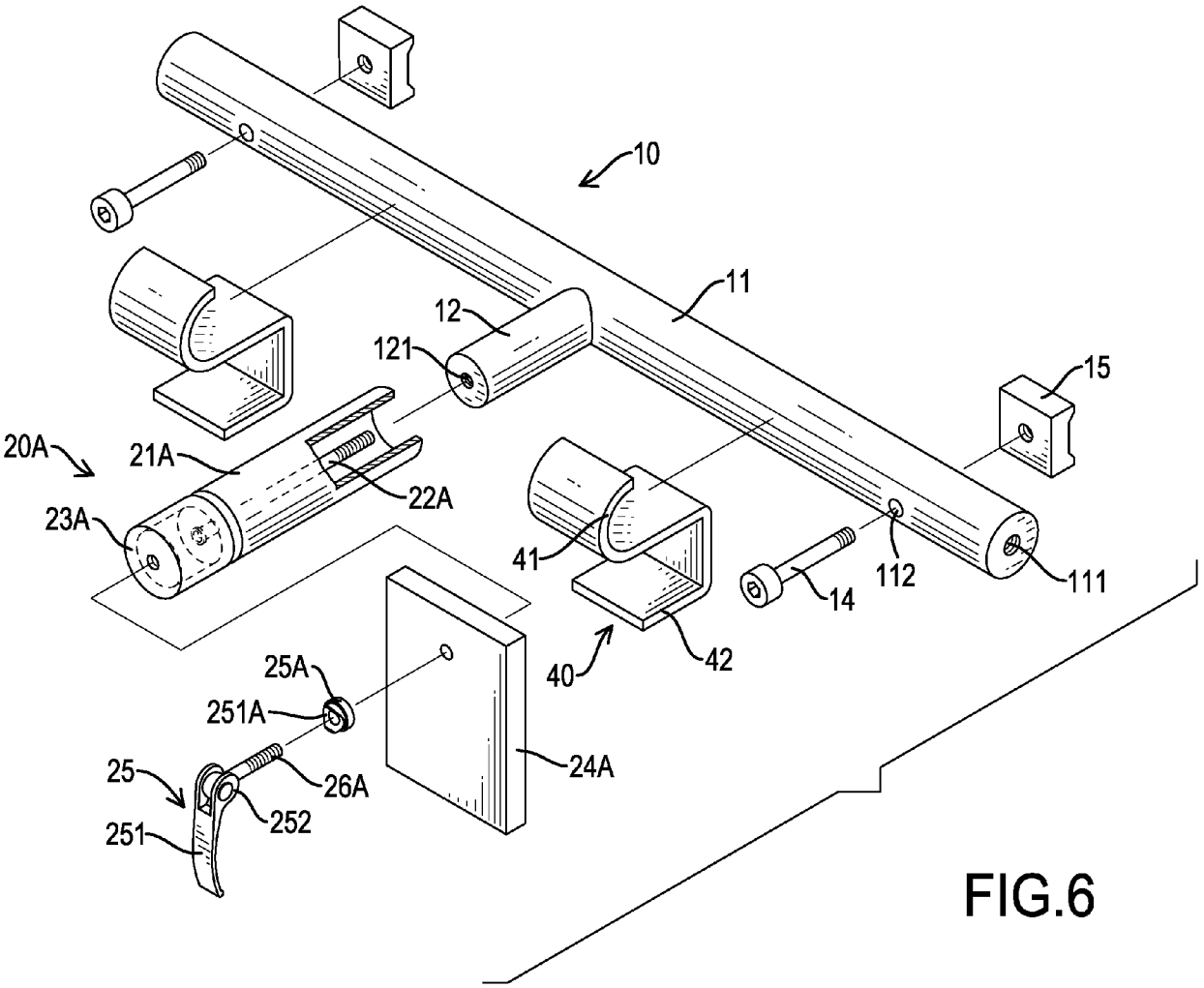
FIG. 6 is an exploded perspective view of a second embodiment of a clamped slide assembly in accordance with the present invention.
Figure 7:
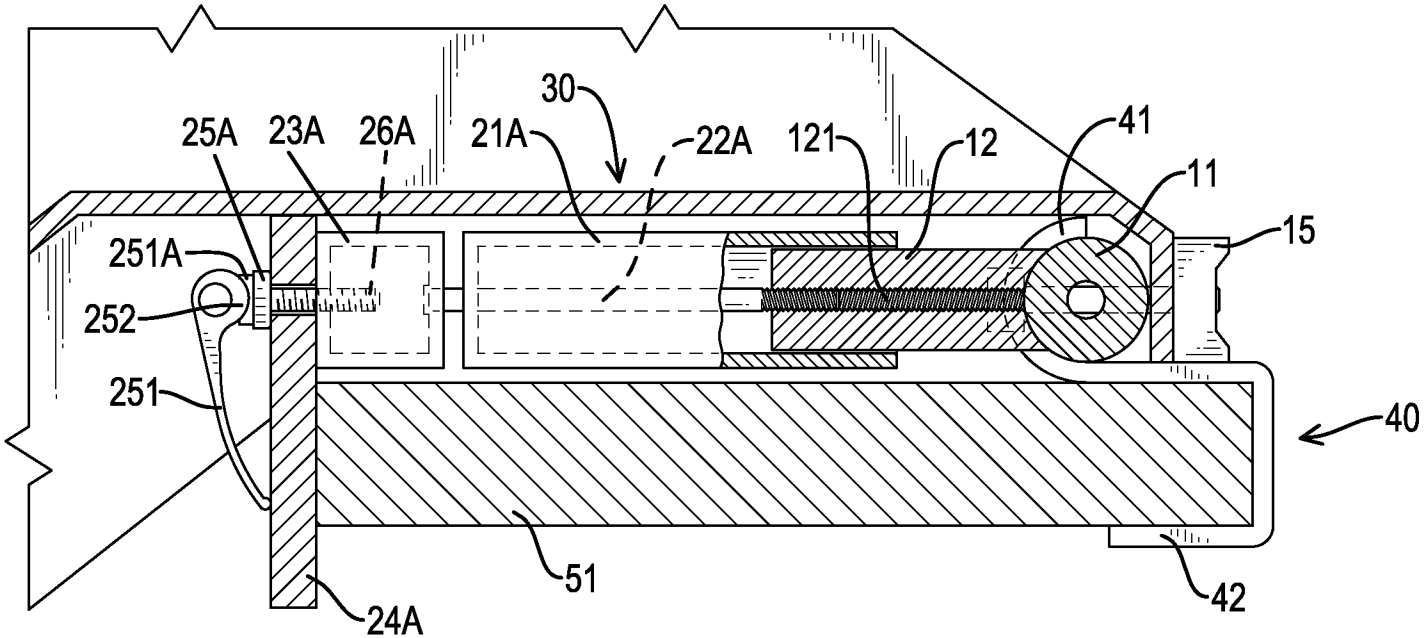
FIG. 7 is an operational and cross-sectional view of the clamped slide assembly in FIG. 6.

With reference to FIGS. 6 to 7, a second embodiment of the clamped slide assembly in accordance with the present invention is basically the same as the first embodiment, but the clamping unit 20A has a sleeve 21A, a first screwing rod 22A, a connecting sleeve 23A, an outer clamping panel 24A, a forcing plate 25A, a second screwing rod 26A, and a spanner 25. The sleeve 21A is movably mounted around the connecting rod 12 of the main body 10. The first screwing rod 22A is mounted through the sleeve 21A and has a thread, and the thread is formed on an end of the first screwing rod 22A. The thread of the screwing rod 22A is screwed with the adjusting screw hole 121 of the connecting rod 12. The connecting sleeve 23A is mounted around another end of the first screwing rod 22A and is distal from the main body 10. The outer clamping panel 24A is securely mounted on a side wall distal from the connecting rod 12 of the connecting sleeve 23A. The forcing plate 25A is securely mounted on a side of the outer clamping panel 24A relative to the connecting sleeve 23A. The forcing plate 25A has a curved groove 251A formed on a side surface of the forcing plate 25A. The second screwing rod 26A is mounted through the forcing plate 25A and the outer clamping panel 24A and is screwed with the connecting sleeve 23A. The two forcing portions 252 of the spanner 25 are eccentrically and pivotally mounted around the second screwing rod 26A. The two forcing portions 252 of the spanner 25 are selectively pushed by the forcing plate 25A. When the turning portion 251 of the spanner 25 is rotated relative to the screwing rod 24, the outer edges distal from a pivoting center of the two forcing portions 252 abut on the curved groove 251A of the forcing plate 25A, and the outer clamping panel 22 is pushed towards the main body 10 and the inner clamping panels 40 by rotating the spanner 25 to fasten the outer clamping panel 24A.

Figure 8:
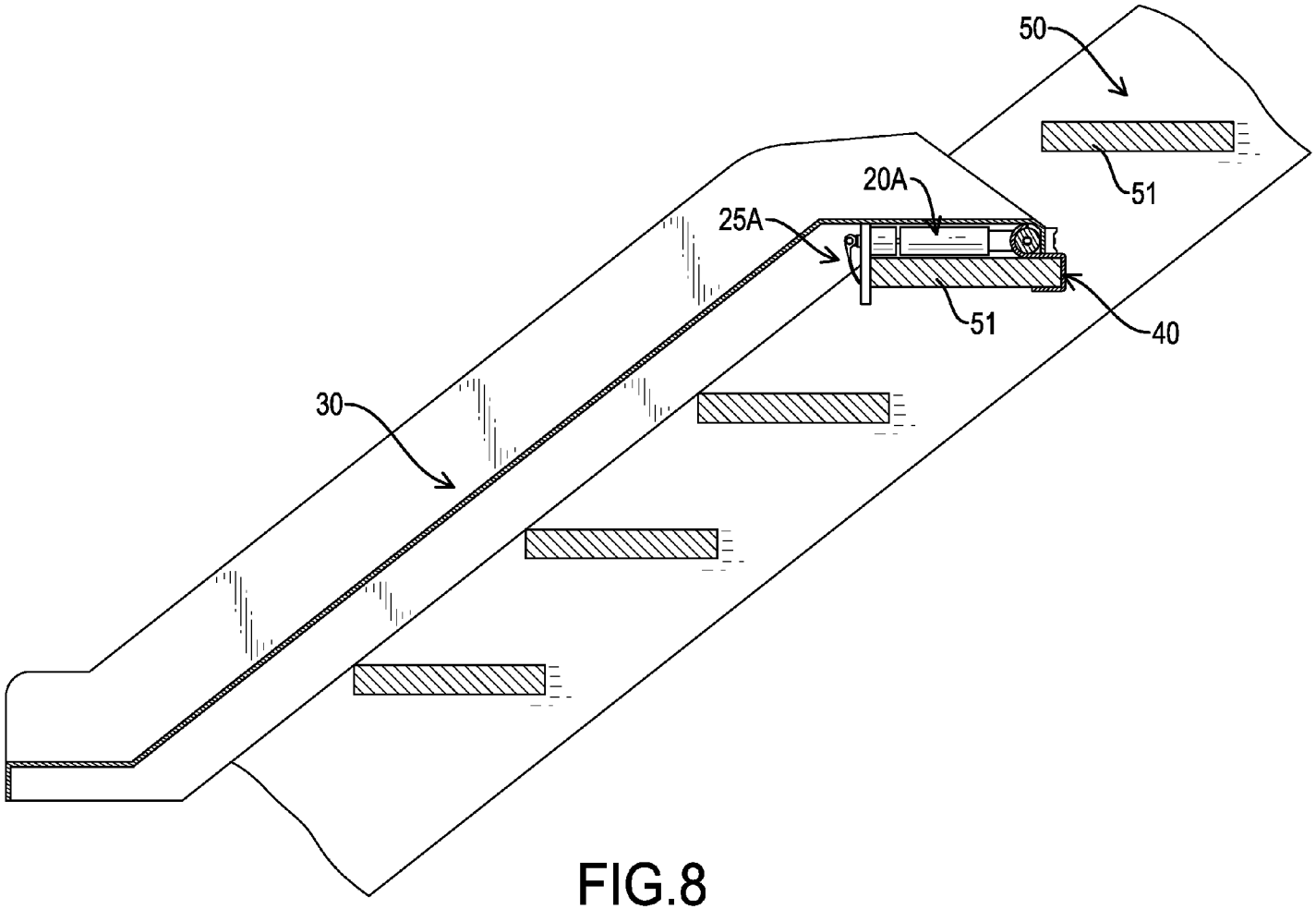
FIG. 8 is a plane view of the clamped slide assembly in FIG. 6, showing the clamped slide assembly mounted on an open riser stair.

With reference to FIGS. 7 and 8, when the second embodiment of the present invention is in use, a position of the sleeve 21A mounted around the connecting rod 12 is adjusted, the screwing depth of the first screwing rod 22A screwed with the adjusting screw hole 121 of the connecting rod 12 is adjusted according to a width of the tread 51 of the open riser stair 50. The connecting sleeve 23A and the outer clamping panel 24A are changed to a suitable position following the variation of the screwing depth of the first screwing rod 22A, and the outer clamping panel 24A is attached on the front surface of the open riser stair 50. The turning portion 251 of the spanner 25 is rotated to fasten with and pull the second screwing rod 26A, and the outer edges of the two forcing portions 252 abut on the curved groove 251A of the forcing plate 25A. So the outer clamping panel 24A and the two inner clamping panels 40 are tightly fastened on the front and back surfaces of the tread 51 of the open riser stair 50.

The first and second embodiments of the present invention are securely mounted on the open riser stair 50 by using the inner clamping panels 40 and the outer clamping panel 22, 24A to fasten on one of the treads 51 of the open riser stair 50. And the outer clamping panel 22, 24A is pushed towards the main body 10 to clamp the tread 51 by rotating the spanner 25, and achieve the goal of combining with an open riser stair 50.

In another preferred embodiment, the inner clamping panels 40 could be a straight plate structure and is securely mounted on the clamping plate 312 of the platform 31 of the slide 30 to achieve the goal of combining with an open riser stair 50.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A clamped slide assembly comprising:

a slide having a platform and a sliding section, and the sliding section connected to the platform;

a main body securely mounted on a bottom of the platform of the slide and having an adjusting screw hole;

at least one inner clamping panel securely mounted on the platform of the slide or the main body and each one of the at least one inner clamping panel extending downward; and a clamping unit movably mounted on the main body and having an outer clamping panel spaced apart from the at least one inner clamping panel;

a screwing rod, an inner end of the screwing rod screwed with the adjusting screw hole of the main body, the screwing rod mounted through the outer clamping panel and an outer end of the screwing rod extending out of the outer clamping panel; and a spanner rotatably and eccentrically mounted on the outer end of the screwing rod, and the outer clamping panel pushed towards the main body and the at least one inner clamping panel by rotating the spanner.

2. The clamped slide assembly as claimed in claim 1, wherein each one of the at least one inner clamping panel has a tread hooking portion, and an opening of the tread hooking portion is disposed towards the outer clamping panel of the clamping unit.

3. The clamped slide assembly as claimed in claim 1, wherein the clamping unit further has a sleeve, the sleeve is movably mounted around the main body, and the outer clamping panel is securely mounted on an end of the sleeve distal from the main body.

4. The clamped slide assembly as claimed in claim 1, wherein the clamping unit further has a forcing plate securely mounted on a side of the outer clamping panel distal from the main body and having a curved groove formed on a side surface of the forcing plate distal from the outer clamping panel; and the spanner has a turning portion; and two forcing portions formed at a spaced interval on a surface of the turning portion, and the two forcing portions eccentrically and pivotally mounted around an end of the screwing rod through the forcing plate;

wherein the turning portion of the spanner is rotated relative to the screwing rod to make outer edges of the two forcing portions distal from a pivoting center of the two forcing portions abut on the curved groove of the forcing plate.

5. The clamped slide assembly as claimed in claim 1, wherein the main body further has a supporting rod; and a connecting rod perpendicularly formed on an outer wall of the supporting rod, wherein the adjusting screw hole of the main body is formed on an end of the supporting rod.

6. The clamped slide assembly as claimed in claim 5, wherein the platform of the slide has two locking plates mounted oppositely on two sides of the platform;

the main body further has two locking members; and the supporting rod has two locking holes, and the two locking members of the main body are respectively mounted through the two locking plates of the platform and are screwed in the two locking holes of the supporting rod.

7. The clamped slide assembly as claimed in claim 6, wherein the platform of the slide has a clamping plate formed between the two locking plates;

the supporting rod of the main body abuts on the clamping plate of the platform and has two clamping holes formed through the outer wall of the supporting rod; and the main body further has two clamping bolts respectively mounted through the two clamping holes of the supporting rod and the clamping plate of the platform; and two pushing blocks respectively screwed with the two clamping bolts, wherein the pushing blocks and the supporting rod clamp the clamping plate of the platform, and the pushing blocks are made of resilient materials.

8. The clamped slide assembly as claimed in claim 5, wherein each one of the at least one inner clamping panel has a supporting hooking portion, and an opening of the supporting hooking portion is distal from the outer clamping panel of the clamping unit and is securely mounted on the outer wall of the supporting rod.

9. The clamped slide assembly as claimed in claim 1, wherein the slide is an integrated structure or a combined structure.

10. A clamped slide assembly comprising:

a slide having a platform and a sliding section, and the sliding section connected to the platform;

a main body securely mounted on a bottom of the platform of the slide and having an adjusting screw hole;

at least one inner clamping panel securely mounted on the platform of the slide or the main body and each one of the at least one inner clamping panel extending downward; and a clamping unit movably mounted on the main body and having a sleeve movably mounted around the main body;

a first screwing rod mounted through the sleeve and screwed with the adjusting screw hole of the connecting rod;

a connecting sleeve mounted around of the first screwing rod and distal from the main body;

an outer clamping panel spaced apart from the at least one inner clamping panel;

a second screwing rod mounted through the outer clamping panel and screwed with the connecting sleeve; and a spanner rotatably and eccentrically mounted on the second screwing rod, and the outer clamping panel pushed towards the main body and the at least one inner clamping panel by rotating the spanner.

11. The clamped slide assembly as claimed in claim 10, wherein each one of the at least one inner clamping panel has a tread hooking portion, and an opening of the tread hooking portion is disposed towards the outer clamping panel of the clamping unit.

12. The clamped slide assembly as claimed in claim 10, wherein the clamping unit further has a sleeve, the sleeve is movably mounted around the main body, and the outer clamping panel is securely mounted on an end of the sleeve distal from the main body.

13. The clamped slide assembly as claimed in claim 10, wherein the clamping unit further has a forcing plate securely mounted on a side of the outer clamping panel distal from the main body and having a curved groove formed on a side surface of the forcing plate distal from the outer clamping panel; and the spanner has a turning portion; and two forcing portions formed at a spaced interval on a surface of the turning portion, and the two forcing portions eccentrically and pivotally mounted around an end of the screwing rod through the forcing plate;

wherein the turning portion of the spanner is rotated relative to the screwing rod to make outer edges of the two forcing portions distal from a pivoting center of the two forcing portions abut on the curved groove of the forcing plate.

14. The clamped slide assembly as claimed in claim 10, wherein the main body further has a supporting rod; and a connecting rod perpendicularly formed on an outer wall of the supporting rod, wherein the adjusting screw hole of the main body is formed on an end of the supporting rod.

15. The clamped slide assembly as claimed in claim 14, wherein the platform of the slide has two locking plates mounted oppositely on two sides of the platform;

the main body further has two locking members;

the supporting rod has two locking holes, and the two locking members of the main body are respectively mounted through the two locking plates of the platform and are screwed in the two locking holes of the supporting rod.

16. The clamped slide assembly as claimed in claim 15, wherein the platform of the slide has a clamping plate formed between the two locking plates;

the supporting rod of the main body abuts on the clamping plate of the platform and has two clamping holes formed through the outer wall of the supporting rod; and the main body further has two clamping bolts respectively mounted through the two clamping holes of the supporting rod and the clamping plate of the platform; and two pushing blocks respectively screwed with the two clamping bolts, wherein the pushing blocks and the supporting rod clamp the clamping plate of the platform, and the pushing blocks are made of resilient materials.

17. The clamped slide assembly as claimed in claim 14, wherein each one of the at least one inner clamping panel has a supporting hooking portion, and an opening of the supporting hooking portion is distal from the outer clamping panel of the clamping unit and securely disposed on the outer wall of the supporting rod.

18. The clamped slide assembly as claimed in claim 10, wherein the slide is an integrated structure or a combined structure.

* * * * *